US006517412B2

(12) United States Patent
Lee et al.

(10) Patent No.: US 6,517,412 B2
(45) Date of Patent: Feb. 11, 2003

(54) METHOD OF CONTROLLING WAFER POLISHING TIME USING SAMPLE-SKIP ALGORITHM AND WAFER POLISHING USING THE SAME

(75) Inventors: Jae-dong Lee, Seoul (KR); Bo-un Yoon, Seoul (KR); Kyoung-mo Yang, Suwon (KR); Sang-rok Hah, Seoul (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/951,506

(22) Filed: Sep. 14, 2001

(65) Prior Publication Data

US 2002/0058460 A1 May 16, 2002

(30) Foreign Application Priority Data

Sep. 20, 2000 (KR) ..... 2000-55205

(51) Int. Cl.[7] ..... B24B 49/00; B24B 51/00; B24B 1/00

(52) U.S. Cl. ..... 451/5; 451/8; 451/41

(58) Field of Search ..... 451/5, 8, 36, 41, 451/59, 63; 216/88, 89; 438/692, 693

(56) References Cited

U.S. PATENT DOCUMENTS 6,315,634 B1 * 11/2001 Jensen et al. ..... 451/10

FOREIGN PATENT DOCUMENTS

| | | |
|---|---|---|
| JP | 10106984 | 4/1998 |
| JP | 1046751 | 6/1998 |
| JP | 1094300 | 11/1998 |

* cited by examiner

*Primary Examiner*—Timothy V. Eley
(74) *Attorney, Agent, or Firm*—Volentine Francos, PLLC

(57) ABSTRACT

A method of controlling a wafer polishing time using a sample-skip algorithm and a method of polishing a wafer using the same are provided. According to the method of controlling a wafer polishing time, a chemical mechanical polishing (CMP) process is performed on a plurality of wafers of an n-th lot among a plurality of lots, each lot consisting of a plurality of wafers, for a time Δt(n), to calculate the amount removed ΔToxP(n) from a polished layer on the wafer. The removal rate $RR_b(n)$ of a layer on a blanket wafer is calculated from the amount removed ΔToxP (n). A CMP time Δt(n+1) is determined for wafers of an n+1-th lot using the relationship equation Δt(n+1)={ΔToxT (n+1)+A}/$RR_b(n)$ where "A" is a constant and ΔToxT(n+1) is the target amount of a layer to be removed from a wafer of an n+1-th lot.

25 Claims, 11 Drawing Sheets

METHOD OF CONTROLLING WAFER POLISHING TIME USING SAMPLE-SKIP ALGORITHM AND WAFER POLISHING USING THE SAME

CROSS-REFERENCES TO RELATED APPLICATIONS

The present application claims priority under 35 U.S.C. §119 to Korean Patent Application No. 00-55205 filed on Sep. 20, 2000, the entire contents of which are hereby incorporated by reference for all purposes.

BACKGROUND OF THE INVENTION

1. Field of the Invention

The present invention relates to a method of polishing a wafer by chemical mechanical polishing (CMP), and more particularly, to a method of controlling wafer polishing time using a sample skip algorithm and a wafer polishing method using the same.

2. Description of the Related Art

Recent progress in high integration of semiconductor devices has lead to ultra-miniaturization. The patterns created for the ultra-miniaturization result in a large step difference in a layer on top of the pattern between a region having the pattern thereon and a region not having the pattern. Due to the miniature structure semiconductor device and its attendant small design rules, precise control of all manufacturing processes to create such devices becomes increasingly important. These manufacturing processes include lithography, etching, chemical vapor deposition (CVD) processes, CMP and the number of times the CMP process is used. The CMP time is determined by the amount to be removed from the initial thickness of a layer being polished on a wafer to the target thickness thereof, and the removal rate of a polishing equipment.

According to conventional CMP processes, the removal rate is obtained by performing a CMP process on a blanket wafer for a predetermined time. In high volume production, such as a mass production line, it is not actually possible to frequently monitor the polished thickness during a CMP process. Thus, each time the CMP process is performed on one lot consisting of a plurality of wafers, a CMP process on a sample wafer to measure a polishing rate, the CMP time is determined based on data resulting therefrom to perform the CMP process on a main lot. However, conventional CMP processes are not only time consuming due to a sample check made for each lot, but also tend to make inaccurate determinations on the CMP time affected by the operator's perspective. Thus, it is highly desirable to develop a general-purpose sample-skip type CMP process which does not require a sample check step. The elimination of the sample check step results in a time-efficient process which reduces processing time.

Furthermore, accurate prediction of CMP time is difficult in conventional CMP processes, due to thickness variations appearing in a layer being polished on each wafer before the CMP process and the removal rate variation attendant on restrictions on the structure of a polishing equipment itself. This is further complicated by the large step difference in miniaturized patterns noted above. For these reasons, research into improving CMP process capability using end-point detection (EPD) or advanced process control (APC) are ongoing.

Representative approaches adopting EPD include using optical principles such as optical interferometry and reflection, and examining motor current changes depending on the difference of friction between layers. However, a method adopting EPD is applicable only to shallow trench isolation (STI) and polishing of a first interlevel insulating layer and a metal layer. It is difficult to adopt in a CMP process for other insulating layers or inter-metal insulating layers due to the complexity of underlying layers.

Furthermore, in a method adopting APC, process control is applied to a semiconductor process to interpret each unit process and organically combines them to thereby transmit actual run data in a feed-back or feed-forward manner, allowing for a run-to-run control while real-time monitoring equipment and process variables. Adopting APC during a CMP process necessitates modeling of the CMP mechanism and creation of a closed loop control (CLC) system. Studies on accurate modeling of a CMP process and its combination with in-line metrology tool are ongoing for a CMP run-to-run control by APC. However, studies made heretofore overlook differences between each polishing head in a multi-head polishing equipment, thus making application to a polishing equipment in current use for mass production unsuitable.

SUMMARY OF THE INVENTION

The present invention is therefore directed to a method of controlling wafer polishing time and a wafer polishing method using the same which substantially overcomes one or more of the problems due to the limitations and disadvantages of the related art.

To solve at least one of the above and other problems, it is an object of the present invention to provide a method of controlling a polishing time of a next lot of wafers by using an algorithm for determining the variable removal rate from the relationship of chemical mechanical polishing (CMP) process data for an actual patterned wafer of a previous lot and the removal rate of a layer being polished on a blanket wafer essential for prediction of a CMP time, in order to realize a sample-skip type CMP process.

It is another object of the present invention is to provide a method of controlling a wafer polishing time, by which a CMP time for a next lot of wafers can be precisely predicted employing an algorithm for effectively reflecting the removal rate of a polished layer which continuously varies depending on equipment features during the polishing process.

It is still another object of the present invention is provide a method of minimizing a variation range between lots which may be widened by using a plurality of heads included in a multi-head type CMP equipment.

It is yet still another object of the invention to provide a method of polishing a wafer using a sample-skip algorithm in which a sample test step is skipped.

Accordingly, to achieve at least one of the above and other objects, the present invention is directed to a method of controlling the polishing time of a wafer. According to the method, a chemical mechanical polishing (CMP) process is performed on a plurality of wafers of an n-th lot among a plurality of lots, each lot consisting of a plurality of wafers, for a time $\Delta t(n)$, to calculate the amount removed $\Delta ToxP(n)$ from a polished layer on the wafer. The removal rate $RR_b(n)$ of a layer on a blanket wafer is calculated from the amount removed $\Delta ToxP(n)$. A CMP time $\Delta t(n+1)$ is determined for wafers of an n+1-th lot using the relationship equation $\Delta t(n+1)=\{\Delta ToxT(n+1)+A\}/RR_b(n)$ where "A" is a constant and $\Delta toxT(n+1)$ is the target amount of a layer to be removed from a wafer of an n+1-th lot.

The removal rate $RR_b(n)$ of the layer on the blanket wafer is calculated using the relationship equation $RR_b(n)=\{\Delta ToxP(n)+A\}/\Delta t(n)$, where "A" is a constant. The constant "A" is determined by $\Delta ToxB=a*\Delta ToxP+A$ which is the relationship equation of a thickness variation $\Delta ToxP$ between before and after CMP on polished layers on wafers of the plurality of lots and a thickness variation $\Delta ToxB$ after CMP on a polished layer on a blanket wafer. If the polished layers on the wafers of the plurality of lots are all formed of the same material, "a" is substantially 1.

The removal rate $RR_b(n)$ of the layer on the blanket wafer maybe obtained from a weighted average value for one or more removal rate data selected from $RR_b(\mathbf{1})$, $RR_b(\mathbf{2})$, $RR_b(\mathbf{3})$, . . . $RR_b(n)$.

A CMP process is performed on one wafer selected among wafers of a first lot for a time $\Delta t(s)$ to obtain the amount removed $\Delta ToxP(s)$ from a polished layer on the selected wafer, where n=1. The removal rate $RR_b(s)$ of the polished layer on the selected wafer is calculated from the amount removed $\Delta ToxP(s)$ by using the relationship equation $RR_b(s)=\{\Delta ToxP(s)+A\}/\Delta t(s)$, where "A" is a constant. A CMP time $\Delta t(\mathbf{1})$ of wafers of the first lot is determined from a target amount $\Delta ToxT(\mathbf{1})$ of a layer to be removed from the wafers of the first lot, using the relationship equation $\Delta t(\mathbf{1})=\{\Delta ToxT(\mathbf{1})+A\}/RR_b(s)$, where "A" is a constant.

At least one of the above and other objects may be created by a method of polishing a wafer. According to the polishing method, the removal rate $RR_b(n)$ of a layer on a blanket wafer is calculated from chemical mechanical polishing (CMP) process data for a plurality of wafers of an n-th lot, among a plurality of lots, each lot consisting of a plurality of wafers. A CMP time $\Delta t(n+1)$ of wafers of an n+1-th lot is determined from the target amount $\Delta ToxT(n+1)$ of a polished layer to be removed from the wafer of the n+1-th lot, using the relationship equation $\Delta t(n+1)=\{\Delta ToxT(n+1)+A\}/RR_b(n)$, where "A" is a constant. A CMP process is performed on a plurality of wafers of the n+1-th lot for the time $\Delta t(n+1)$.

The calculating of the removal rate $RR_b(n)$ of the layer on the blanket wafer includes performing a CMP process on the wafers of the n-th lot for a time $\Delta t(n)$ to calculate the amount removed $\Delta ToxP(n)$ from a polished layer on the wafer, and calculating the removal rate $RR_b(n)$ from the amount removed $\Delta ToxP(n)$.

A wafer polishing method according to the present invention involves sequentially performing a CMP process on a plurality of wafers constituting each lot by two or more wafers using a CMP equipment including two or more heads.

The present invention makes possible a CMP process for in situ controlling a CMP time of the following lot with a closed loop control (CLC) system in a sample-skip manner using an algorithm for calculating a variable removal rate set with a weighting factor while minimizing the range of differences between lots which may be widened by using a plurality of heads in a multi-head type equipment, thereby effectively reducing fluctuations in the removal rate between heads. Furthermore, regardless of product types of a wafer polished in the preceding run, the invention allows a CMP process to be performed for various kinds of products.

These and other objects of the present invention will become more readily apparent from the detailed description given hereinafter. However, it should be understood that the detailed description and specific examples, while indicating the preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

In the following detailed description, for purposes of explanation and not limitation, exemplary embodiments disclosing specific details are set forth in order to provide a thorough understanding of the present invention. However, it will be apparent to one having ordinary skill in the art having had the benefit of the present disclosure, that the present invention may be practiced in other embodiments that depart from the specific details disclosed herein. Moreover, descriptions of well-known devices, methods and materials may be omitted so as to not obscure the description of the present invention.

To determine a chemical mechanical polishing (CMP) time during a CMP process, data on pre-CMP thickness pre-Tox of a layer to be polished and a removal rate of the layer to be polished needs to be provided, in which case the removal rate data is obtained from a polishing equipment.

However, since the pre-Tox data is obtained using a usual measurement tool, but data on the removal rate is obtained by monitoring using a blanket wafer, it is difficult to know the exact value exhibited by a CMP equipment in real time during CMP. The present invention involves developing an algorithm for in-situ computing the removal rate data from actual run data using a CMP equipment, and minimizing a removal rate variation due to the difference in characteristics of each of a plurality of heads within a polishing equipment. Furthermore, this invention proposes a method of controlling a wafer polishing time which allows a CMP run-to-run control by a sample-skip algorithm by constructing this algorithm with a closed loop control (CLC) system, and a wafer polishing method using the same.

Figure 1:
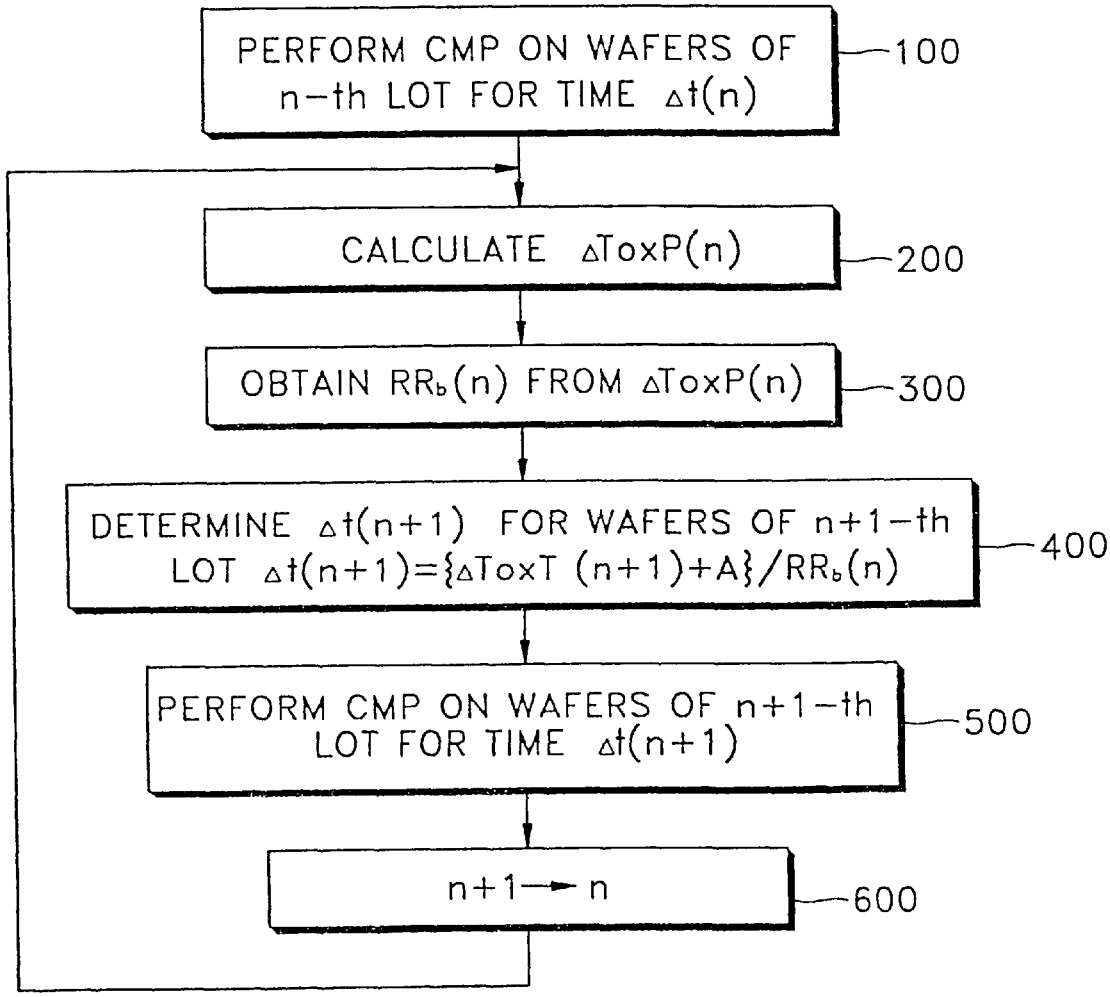
FIG. 1 is a flowchart for explaining a method of polishing a wafer according to the present invention.

Referring to FIG. 1, first, in step 100, among a plurality of lots, each of which consists of a plurality of wafers, a CMP process is performed on a plurality of wafers in an n-th lot for a time $\Delta t(n)$. Subsequently, in step 200, the amount removed $\Delta ToxP(n)$ of a polished layer on a wafer obtained as a result of CMP is calculated. In step 300, the removal rate $RR_b(n)$ of a layer on a blanket wafer is then calculated from the amount removed $\Delta ToxP(n)$ from the polished layer on the wafer. Here, the removal rate $RR_b(n)$ of the polished layer on the blanket wafer is obtained using the relationship equation $RR_b(n)=\{\Delta ToxP(n)+A\}/\Delta t(n)$, where "A" is a constant. The constant "A" is determined using $\Delta ToxB=a*\Delta ToxP+A$ which is the relationship between a thickness variation $\Delta ToxP$ between before and after CMP for a layer on a wafer of the plurality of lots and a thickness variation $\Delta ToxB$ between before and after CMP for a layer on the blanket wafer. Here, if the layers to be polished on the wafers of the plurality of lots are all formed of the same material, "a" is substantially 1, while if two different layers to be polished are used, "a" is expressed by the ratio of the removal rate between the two layers.

The removal rate $RR_b(n)$ of the layer on a blanket wafer maybe obtained from a weighted average value of one or more removal rate data selected among $RR_b(1)$, $RR_b(2)$, $RR_b(3)$, . . . , $RR_b(n)$. The weighted average value may be obtained by removal rate data selected among $RR_b(1)$, $RR_b(2)$, $RR_b(3)$, . . . , $RR_b(n)$, each of which may be set with the same weighting factor or different weighting factors. In step 400, a CMP time $\Delta t(n+1)$ for wafers of an n+1-th lot is determined using the relationship equation $\Delta t(n+1)=\{\Delta ToxT(n+1)+A\}/RR_b(n)$, where $\Delta ToxT(n+1)$ is the target amount of a layer to be removed from the wafer of the n+1-th lot. Here, the constant "A" is defined as above. In step 500, a CMP process is performed on a plurality of wafers of the n+1-th lot for the time $\Delta t(n+1)$. In step 600, n+1 is substituted into n to repeat the algorithm of the step 200 to the step 500 with a CLC system, thereby completing a CMP process for all lots to be polished.

According to the algorithm of FIG. 1, where n=1, a CMP process is performed on one wafer selected from among the wafers of a first lot for a time $\Delta t(s)$ to obtain the amount removed $\Delta ToxP(s)$ from a polished layer on the selected wafer. Subsequently, the removal rate $RR_b(s)$ of the layer on the selected wafer is obtained using the relationship equation $RR_b(s)=\{\Delta ToxP(s)+A\}/\Delta t(s)$, where "A" is a constant. A CMP time $\Delta t(1)$ of wafers of the first lot is then determined from the target amount $\Delta ToxT(1)$ of layers to be removed from the wafers of the first lot, using the relationship equation $\Delta t(1)=\{\Delta ToxT(1)+A\}/RR_b(s)$, where "A" is a constant. Subsequently, CMP is performed on the remaining wafers of the first lot, excluding the selected wafer for the time $\Delta t(1)$.

$\Delta ToxP(1)$ is obtained after CMP for the time $\Delta t(1)$, and $RR_b(1)$ is obtained using $RR_b(1)=\{\Delta ToxP(1)+A\}/\Delta t(1)$ to calculate the removal rate of a blanket wafer of the first lot. The removal rate $RR_b(1)$ is used in determining a CMP time of a second lot.

When performing a CMP process on a plurality of wafers in each lot using the algorithm shown in FIG. 1, the CMP process may be sequentially performed by two or more wafers, for example, four wafers using a CMP equipment having two or more heads, for example, four heads.

During a CMP process on a patterned wafer, to perform a run-to-run control in a sample-skip manner, it is necessary to obtain removal rate data of a layer to be polished in real time from equipment used during the actual process. According to the conventional art, the removal rate data of a layer to be polished is made available through monitoring using a blanket wafer, but it is difficult to obtain accurate data of a run in real time from a CMP equipment. To solve this problem, the present invention involves employing a CMP planarization mechanism and building a new model for determining the relationship between actual removal rate data available after having performed an actual CMP process based on the CMP planarization mechanism and removal rate data obtained from a blanket wafer.

In a typical CMP planarization mechanism, the removal rate on a patterned wafer is different from that on a blanket wafer during the first stage of CMP until a step difference on the surface of a polished layer due to a wafer pattern is removed. Once the surface is planarized, the pattered wafer exhibits the same removal rate variation as the blanket wafer.

Figure 2A:
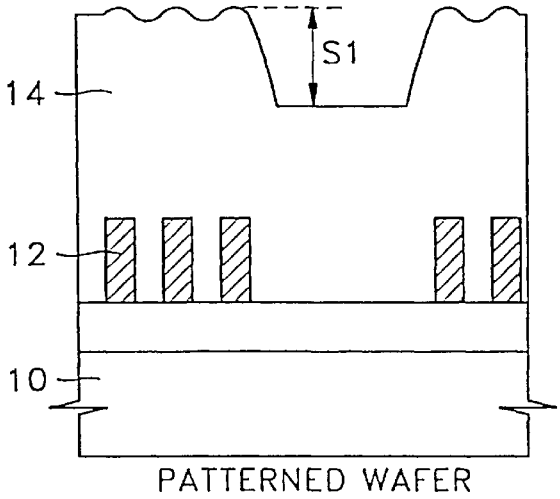
FIGS. 2A–2F are cross-sectional views showing changes in the profile of an insulating layer deposited over the entire surface of each wafer until completion of a chemical mechanical polishing (CMP) process from before the CMP process, when the CMP process is performed on a patterned wafer and a blanket wafer under the same conditions for the same time.
Figure 2B:
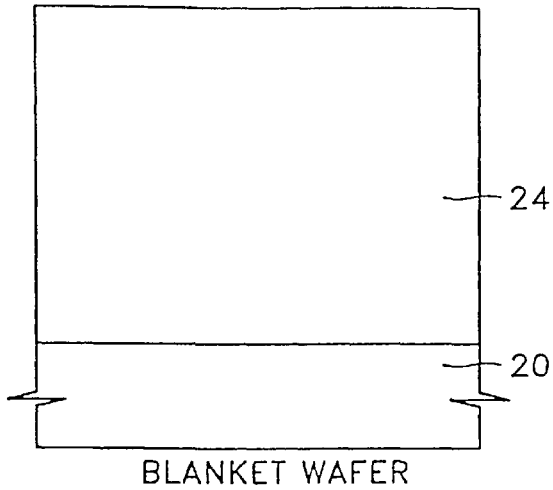

FIGS. 2A–2F are cross-sectional views showing changes in the profiles of insulating layers deposited over the entire surfaces of patterned wafer and blanket wafer, when performing a CMP process on each wafer under the same conditions for the same amount of time, the changes being measured throughout the CMP. Specifically, as shown in FIG. 2A, on a wafer in which a pattern 12 is formed, a step difference S1 is provided on an insulating layer due to the pattern 12, while as shown in FIG. 2B, on a blanket wafer an insulating layer 24 of a planar surface is provided.

Figure 2C:
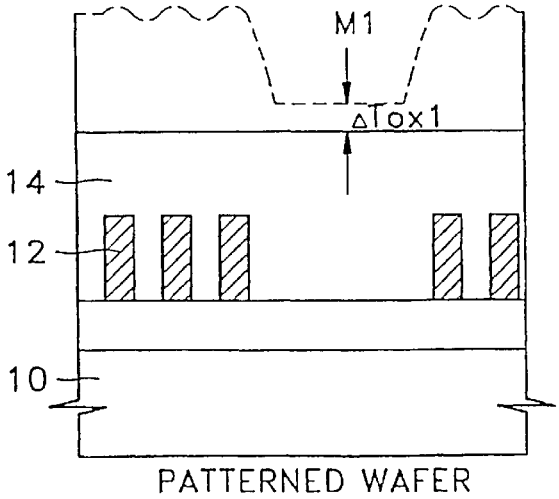
Figure 2D:
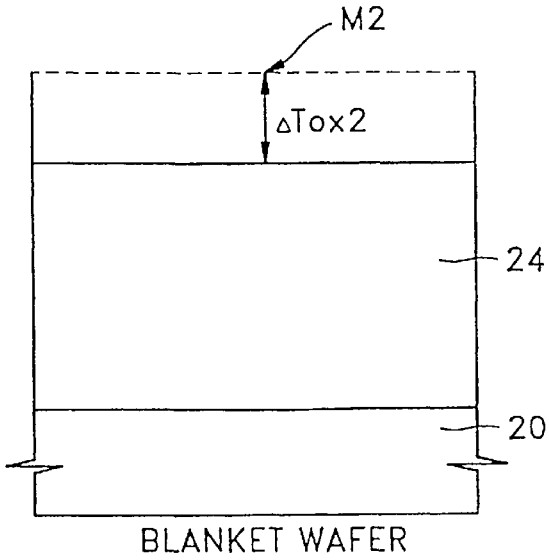

FIGS. 2C and 2D show thickness variations on arbitrary monitoring sites M1 and M2 after having performed CMP for the insulating layers 14 and 24 on each wafer 10 and 20 until the step difference S1 on the insulating layer 14 on the wafer 10 in which the pattern 12 is formed is removed. Here, the relationship between the amount removed $\Delta Tox1$ from the insulting layer 14 on the patterned wafer 10 and the amount removed $\Delta Tox2$ from the insulating layer 24 on the blanket wafer 20 is nonlinear.

Figure 2E:
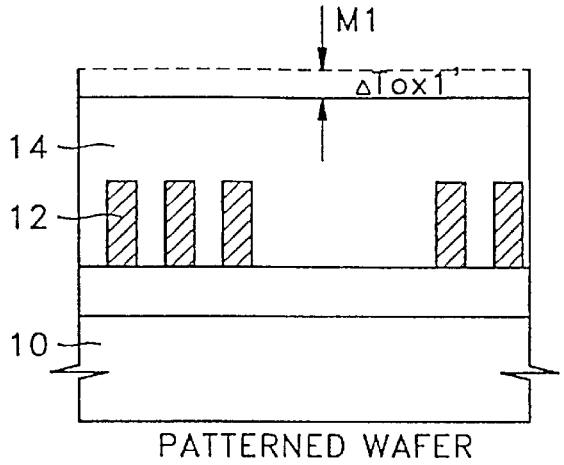
Figure 2F:
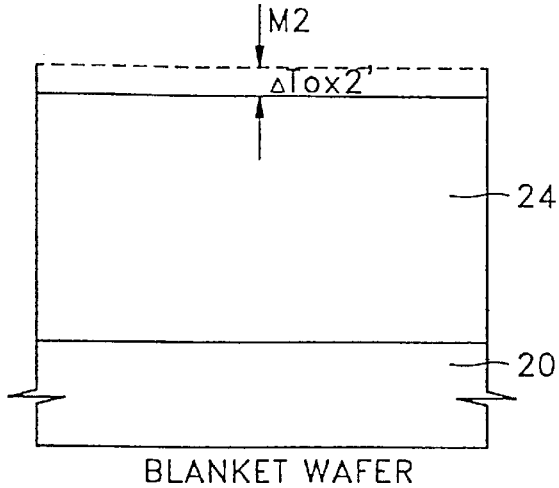

FIGS. 2E and 2F shows thickness variations on the monitoring sites M1 and M2 after having completed the CMP planarization process. Here, after the insulating layer 14 has been planarized, as shown in FIGS. 2E and 2F, the relationship between the amount removed $\Delta Tox1'$ corresponding to a thickness variation of the insulating layer 14 on the patterned wafer 10 and the amount removed $\Delta Tox2'$ corresponding to a thickness variation of the insulating layer 24 on the blanket wafer 20 is linear. In particular, if the insulating layers 14 and 24 are formed of the same material, the slope is approximately one.

As described above with reference to FIGS. 2A–2F, after planarization of the polished layer on the pattered wafer, in which the step difference formed due to the pattern is removed, the thickness variation of the polished layer is substantially the same as that of the polished layer on the blanket wafer.

Figure 3:
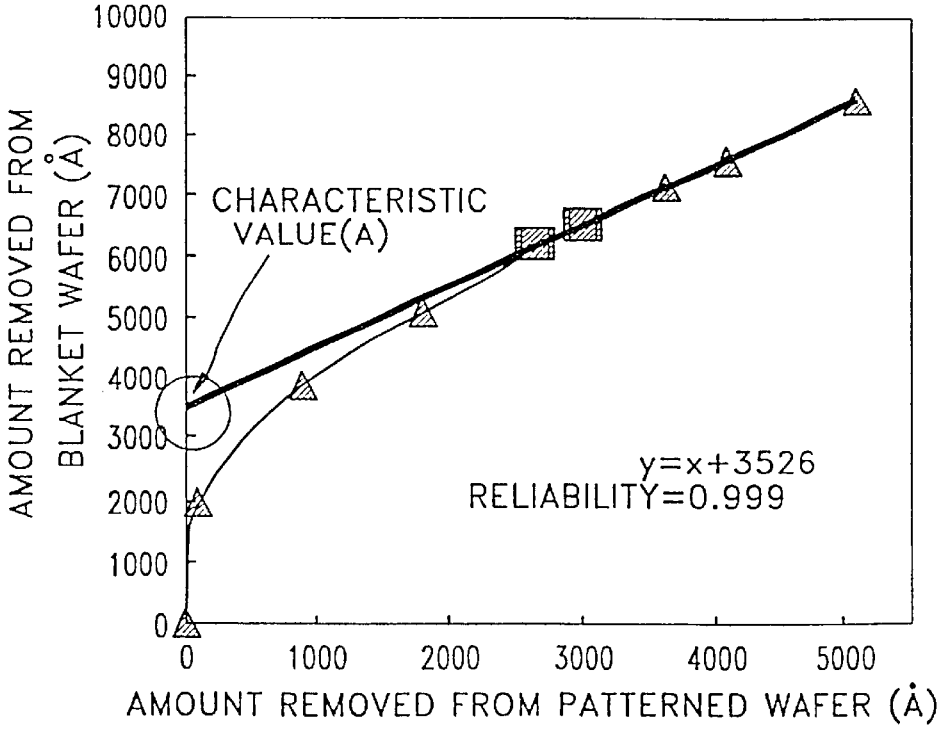
FIG. 3 is a graph showing the relation between thickness variations of a layer being polished on a patterned wafer and a blanket wafer.

FIG. 3 is a graph showing the relationship between thickness variations of polished layers on a patterned wafer and a blanket wafer before and after the point in time at which a layer to be polished on the pattered wafer is planarized. The slope of the relationship of thickness variations after planarization of the layer to be polished on the patterned wafer is approximately one.

Based on this principle, the relationship between a thickness variation ΔToxP of a layer to be polished on a patterned wafer and a thickness variation ΔToxB of a layer to be polished on a blanket wafer is expressed by Equation (1).

$$\Delta ToxB=\Delta ToxP+A \quad (1)$$

In Equation (1), the nonlinear relationship between a thickness variation of a layer to be polished on a patterned wafer and a thickness variation of a layer to be polished on a blanket wafer during polishing from the state shown in FIG. 2A to the state shown in FIG. 2B is affected by an actual pattern formed on the wafer, which can be expressed by a characteristic value indicated by a value "A". The value "A" in Equation (1) physically refers to a thickness variation of a layer to be polished on a blanket wafer removed until the layer to be polished on a wafer in which a specific pattern is formed is planarized, and the value "A" may vary depending on the pattern of each product or CMP conditions.

After having completed a CMP process on a wafer in which an actual pattern is formed, by substituting the thickness variation of the polished layer on the wafer into Equation (1), the thickness variation of a layer to be polished on a blanket wafer can be obtained.

Figure 4A:
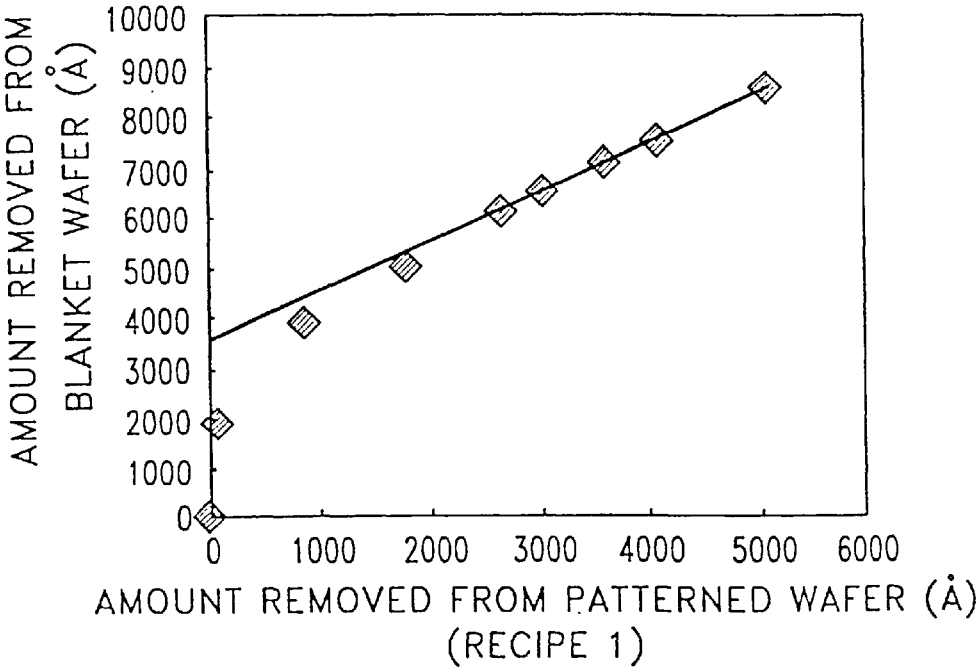
FIGS. 4A and 4B are graphs expressing a variation in the amount removed from a polished layer on a blanket wafer as a function of the amount removed from a polished layer on a patterned wafer in different recipes.
Figure 4B:
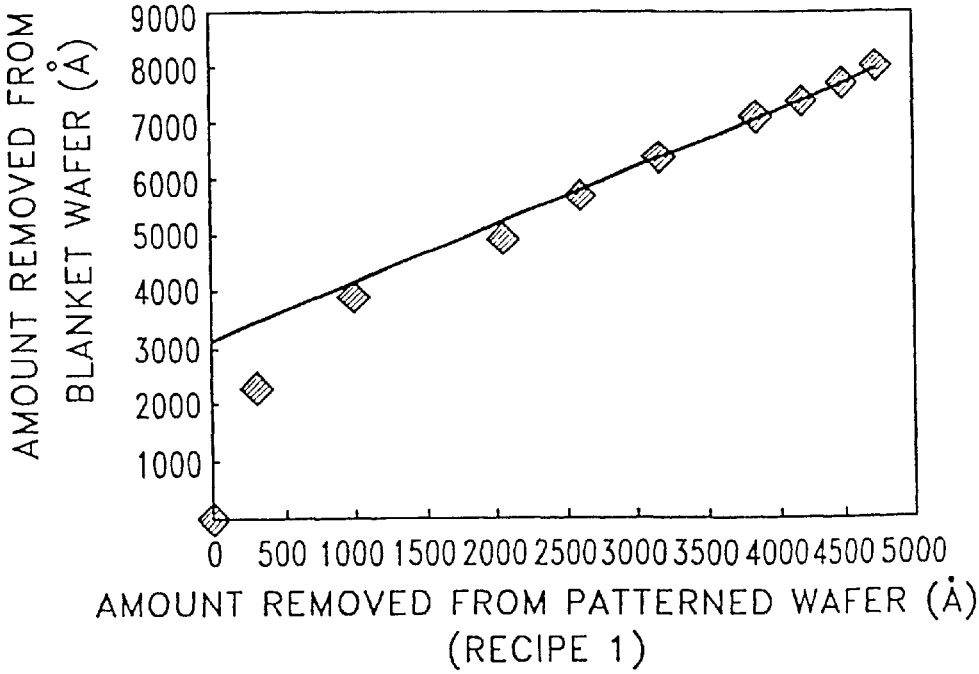

FIGS. 4A and 4B are graphs expressing the variation in the amount removed from a layer to be polished on a blanket wafer as a function of the amount removed from a layer to be polished on a patterned wafer in different recipes. More specifically, when polishing the layers to be polished on two wafers of the same pattern under different CMP conditions indicated by Recipe 1 (FIG. 4A) and Recipe 2 (FIG. 4B), thickness variations are measured at thickness measurement sites on the patterned wafers. At the same time, thickness variations of layers to be polished formed on blanket wafers under conditions of the Recipes 1 and 2 are measured at the same thickness measurement sites. Thus, the relationship between variations in the amounts removed from the patterned wafer and the blanket wafer can be plotted as a graph.

As is evident from FIGS. 4A and 4B, if the thickness variation of the layer to be polished on the patterned wafer is small, the relationship between the thickness variation on the blanket wafer simultaneously polished is nonlinear. After the layer to be polished on the patterned wafer is planarized, that is, after removal of an initial predetermined thickness, the relationship therebetween is linear, as expressed by Equation (1). Furthermore, the characteristic value "A" is determined in each recipe.

If the relationship of thickness variations on a patterned wafer and a blanket wafer is expressed by Equation (1), based on actual CMP process data of the pattered wafer, the thickness variation of a layer to be polished of the same material on the blanket wafer can be predicted. The predicted thickness variation is divided by the time to calculate the removal rate of a specific layer available in a specific equipment. That is, without undergoing a separate monitoring step, a CMP removal rate available from the CMP equipment can be calculated from data obtained as a result of performing an actual CMP process on the patterned wafer. The relationship equation can apply to all kinds of patterns in the same manner, in which case only the characteristic value "A" varies depending on the applied conditions.

The characteristic value "A" varies depending on several factors, such as a pressure imposed on a wafer, a rotating speed of platen, a CMP recipe used during CMP on a wafer in which the same pattern is formed, and a pattern formed on a wafer. However, it was ascertained that the characteristic value "A" represents the same in the case where a CMP process is performed on a wafer, on which certain patterns are formed, under the same polishing recipe. The removal rate RR of a layer to be polished available from a CMP equipment is obtained from the relationship equation such as Equation (2):

$$RR=\Delta ToxB/\Delta t \quad (2)$$

where Δt denotes a CMP time.

Based on Equations (1) and (2), the relationship for in-situ calculating a variable removal rate for a polished layer on a blanket wafer available from a CMP equipment using a thickness variation ΔToxP(n) of a layer to be polished on a patterned wafer in an n-th run, a CMP time Δt(n), and a characteristic value "A", is expressed by Equation (3):

$$RR_b(n)=\{\Delta ToxP(n)+A\}/\Delta t(n) \quad (3)$$

Using Equation (3), the removal rate of the layer to be polished on the blanket wafer is available from a CMP equipment from CMP data for the wafer in which an actual pattern is formed without a separate monitoring step using a blanket wafer. In particular, since the removal rate data in-situ obtained using the characteristic "A" of a previously processed run, is one for a blanket wafer not affected by the type of products, the removal rate data is applicable to any product of a different pattern.

If the removal rate of a layer to be polished on a blanket wafer is determined from actual CMP data for a patterned wafer in this way, a CMP time Δt(n+1) for a subsequent lot is determined as expressed by Equation (4):

$$\Delta t(n+1)=\{\Delta ToxT(n+1)+A\}/RR_b(n) \quad (4)$$

where ΔToxT(n+1) denotes a target amount to be removed from a layer to be polished on a wafer of an n+1-th lot, the target amount being equal to the amount of subtracting the target thickness $T_{target}$(n+1) of the layer to be polished from the pre-CMP thickness pre-Tox (n+1) thereof.

Using Equation (4), a CMP time for a lot in the n+1-th run can be calculated, and since there is no need for separate monitoring using a sample wafer, a CMP sample-skip process is allowed. Furthermore, processing data obtained in-situ as described above with a computer allows a subsequent lot to be consecutively processed without a monitoring process using a sample in each lot by determining a CMP time by a closed loop control algorithm.

Meanwhile, even during CMP of a layer of the same material, the removal rate available from a CMP equipment varies from wafer to wafer or from lot to lot. This removal rate variation occurs dramatically in the case of a CMP equipment into which a wafer is loaded by a multi-head system. This is due to a difference in the removal rate between the heads resulting from the characteristics of each head itself. For example, if a CMP equipment has four heads like the MIRRA equipment manufactured by Applied Materials Co., there may be a large removal rate variation in one head itself or between the heads. This makes it difficult to set the removal rate at a desired target across the entire run. On the other hand, while a variation in removal rates obtained during CMP is apt to be irregular, but the removal rates do not deviate largely from a predetermined range.

Figure 5A:
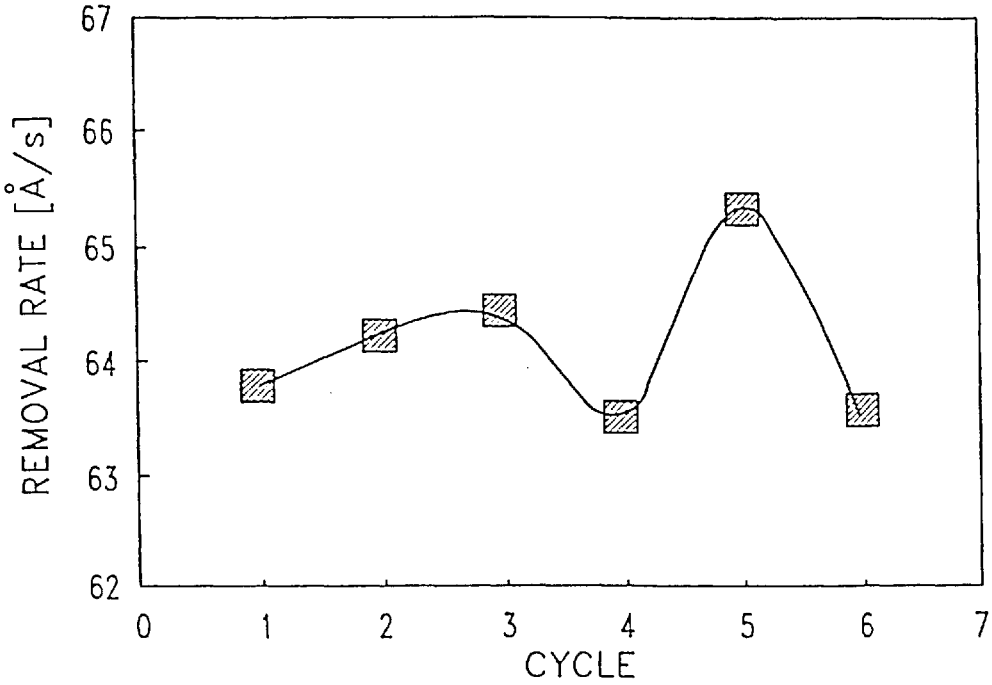
FIGS. 5A–5C are graphs of removal rate variations of a polished layer obtained using a typical CMP equipment.
Figure 5B:
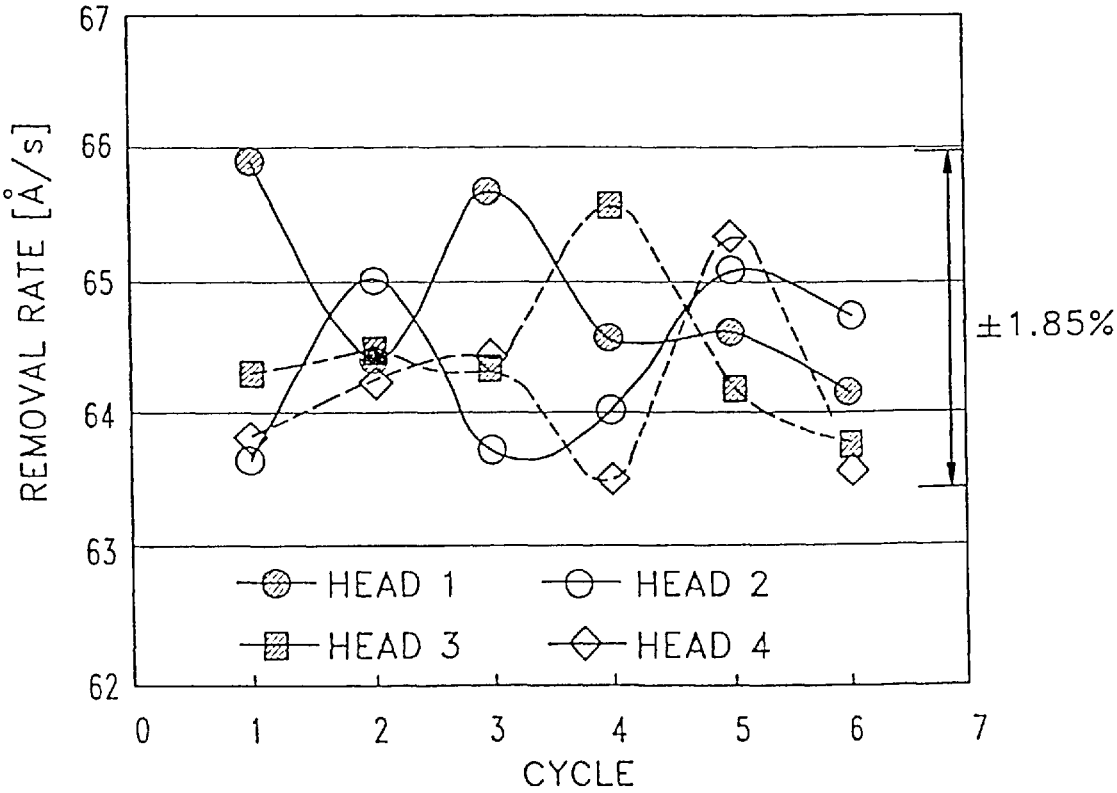
Figure 5C:
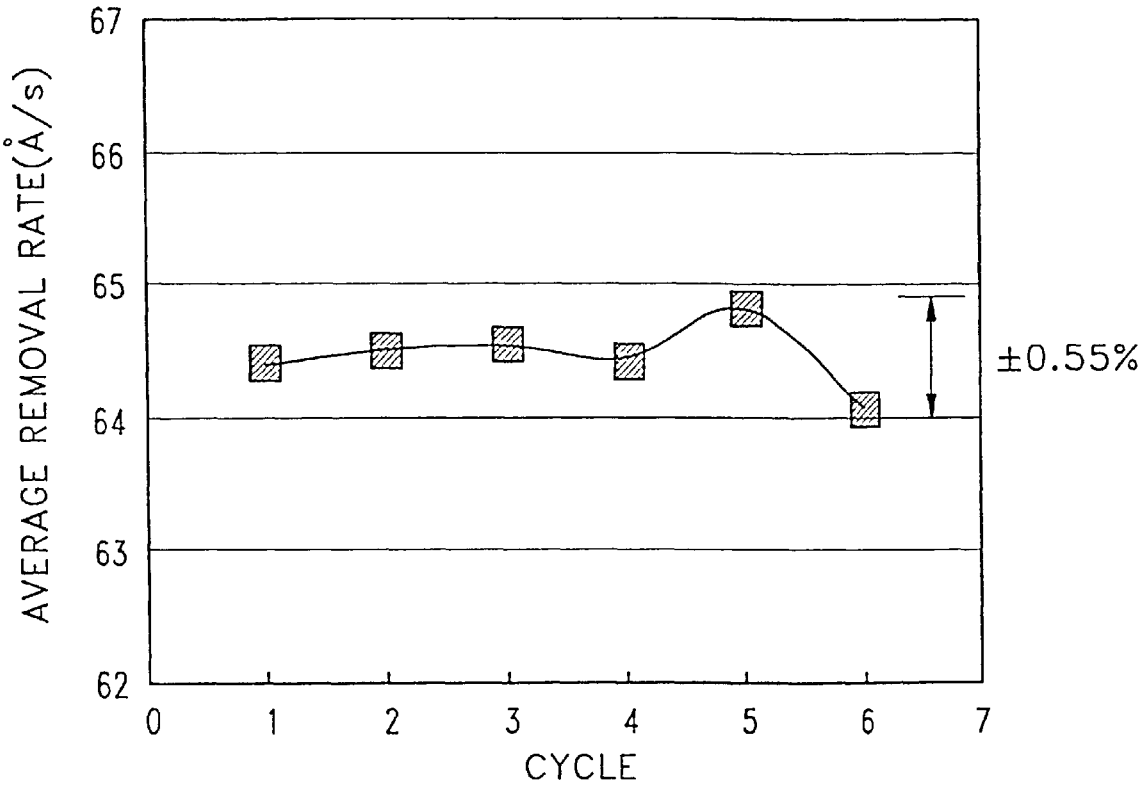

FIGS. 5A–5C are graphs showing removal rate variations of a layer to be polished obtained using a MIRRA equipment. FIG. 5A shows the removal rate variation in one head itself occurring at each cycle, FIG. 5B shows the removal rate variation in each of four heads occurring at each cycle, and FIG. 5C shows the variation in the average value of removal rate data for the four heads obtained at each cycle.

As shown in FIG. 5B, removal rates obtained from four different heads are distributed randomly and irregularly with a range of the order of ±1.85% from the average value. On the other hand, as is evident from FIG. 5C, an average value of removal rates available from each head is distributed in a relatively small range on the order of ±0.55%. Based on this fact, a factor for optimizing removal rates available from the CMP equipment can be determined. In other words, if this fact applies to the algorithm for determining a CMP time during a sample-skip CMP process, after calculating removal rates in-situ obtained from each head during CMP, an average removal rate obtained from those removal values is used instead of $RR_b(n)$ in Equation (4) to thereby minimize the effect which is attendant on a removal rate variation between the heads, and improve the capability of achieving a target removal rate.

The method, in which an average removal rate available during CMP is used based on the above fact, involves measuring one wafer for each head by considering four heads provided in a MIRRA equipment in each run, and calculating the average value of removal rates obtained therefrom. However, a thickness measurement equipment currently being used for mass production is a stand-alone type offering very low throughput. Thus, taking into account the fact that only one wafer of each run is checked in a current mass production process, it is difficult to apply a method of checking four wafers in each run as described above. On the other hand, the removal rate data obtained from each run randomly represents removal rates available from different four heads. Thus, the average value thereof is deemed to approach the average value of removal rates exhibited by four different heads.

Typical approaches using the average value of removal rates include a method of using a linear average value of removal rates and a method of setting appropriate weighting factors on values obtained from the last few runs. However, in addition to a removal rate variation in a CMP equipment itself, the removal rates available during a CMP process vary depending on the useful life of consumables such as pads. For this reason, selectively setting weighting factors among obtained data may be better than using a linear average value. Thus, the present invention involves calculating an optimized removal rate set with a weighting factor using an equation such as Equation (5):

$$RR_w(n)=RR_b(n)*f1+RR_b(n-1)*f2+RR_b(n-2)*f3+\ldots \quad (5)$$

where $RR_b(n)$, $RR_b(n-1)$, $RR_b(n-2)$ denote removal rates for layers to be polished on blanket wafers obtained from n-th, n−1-th, and n−2-th lots, respectively, and f1, f2, and f3 denote weighting factors for n-th, n−1-th, and n−2-th lots, respectively. The weighting factors may be set to be equal or approximated most closely according to the current run in terms of equipment status.

A method of controlling a wafer polishing time according to the present invention involves using an algorithm for calculating a variable removal rate set with a weighting factor represented by Equation (5) to calculate the removal rate for a blanket wafer. Thus, the method according to this invention can be effectively applied to a CMP equipment having large removal rate fluctuations or a multi-head type CMP equipment, and, in particular, it enables the removal rate of a layer to be polished obtained as a result of CMP using a plurality of heads to be distributed in a minimal range near a target value.

EVALUATION EXAMPLE 1

To control a wafer polishing time using a sample-skip method during an actual CMP process, this evaluation example involved calculating a removal rate for a blanket wafer by data obtained from the actual CMP process using the algorithm as described above, and then comparing the removal rate obtained through measurement on a blanket wafer subjected to an actual CMP process with the calculated removal rate to ensure the validity thereof.

A patterned wafer used for the test was a wafer for a DRAM product, while the layer to be polished was a borophosphosilicate glass (BPSG) layer used as an interlevel insulating layer. Since a BPSG layer to be removed by CMP is subjected to an annealing process in actual process, a BPSG layer formed on a blanket wafer was subjected to CMP after going through annealing under the same conditions. A CMP equipment used for this test was a MIRRA equipment having four heads, and CMP was performed in the same head in order to minimize an error during the test. The conditions of CMP were as shown in Table 1.

TABLE 1

| | Recipe 1 | Recipe 2 |
|---|---|---|
| Membrane pressure | 5.6 psi | 5.7 psi |
| Platen speed | 36 rpm | 47 rpm |

After having planarized the patterned wafer through CMP under the above two separate conditions of Table 1, the relationship between the removal amount of the BPSG layer obtained from the blanket wafer and the patterned wafer are expressed by Equation 1 as follows:

$$\text{Recipe } \mathbf{1}\text{: } \Delta ToxB_1=0.977*\Delta ToxP_1+3526(R^2=0.999)$$

$$\text{Recipe } \mathbf{2}\text{: } \Delta ToxB_2=0.999*\Delta ToxP_2+3138(R^2=0.997)$$

Here, $R^2$ denotes the reliability of the obtained relationship equation, and the conditions of recipes 1 and 2 can be expressed by Equation (1).

The amount removed from each BPSG layer for a blanket wafer obtained from the above two relationship equations was substituted into Equation (3) to calculate the removal rate of each BPSG layer on the blanket wafer. Furthermore, the amount removed from each BPSG layer on the blanket wafer subjected to CMP simultaneously with the patterned wafer in the same head under the conditions of Recipes 1 and 2 was measured, and then the measured amount removed was divided by a CMP time to calculate the removal rate of BPSG layer on the blanket wafer. Table 2 below shows the result of comparing the calculated removal rate for the blanket wafer with the actually measured removal rate.

TABLE 2

| Removal rate on blanket wafer (Å/min) | Recipe 1 | | Recipe 2 | |
|---|---|---|---|---|
| | Sample 1 | Sample 2 | Sample 3 | Sample 4 |
| Removal rate calculated from data of patterned wafer | 4036 | 3718 | 4515 | 4491 |
| Removal rate actually measured | 4068 | 3716 | 4606 | 4606 |
| Error rate | 0.8% | 0.05% | 1.9% | 2.4% |

As is evident from Table 2, in which the samples were all patterned wafers, there is a very slight difference between the removal rate on the blanket wafer, which is calculated from data of the patterned wafer in the test conducted under each CMP condition, and the actually measured removal rate on the blanket wafer. Thus, without a need for undergoing a separate test for evaluating the removal rate using a blanket wafer, removal rate data for a blanket wafer available from the CMP equipment is readily calculated by substituting data obtained from the patterned wafer into the relationship equations defined above based on the algorithm for calculating a variable removal rate used in the present invention.

EVALUATION EXAMPLE 2

This evaluation example involved performing a CMP process with a MIRRA equipment having four heads and calculating a variable removal rate set with a weighting factor by the relationship equation of Equation (5). In this case, the removal rate for a blanket wafer in each lot was calculated using the relationship equation obtained for Recipe 1 in Evaluation Example 1, that is, $\Delta ToxB_1 = 0.977 * \Delta ToxP_1 + 3526$.

A patterned wafer used for a test which was a wafer for a DRAM product was applied to a CMP process for polishing a BPSG layer used as an interlevel insulating layer. In this case, all four heads included in the MIRRA equipment were used to perform the CMP process. First, after having performed the CMP process on one sample wafer of a first lot for a predetermined CMP time, the thickness variation of a polished layer was measured. Then, removal rate $RR_b(\mathbf{1})$ on a blanket wafer was determined using the relationship equation obtained for the Recipe 1 in Evaluation Example 1, and the removal rate $RR_b(\mathbf{1})$ obtained therefrom was reflected to calculate a CMP time required for a subsequent lot. Continuously, the CMP process is performed by a CLC algorithm for determining the CMP time of an n+1-th lot from a removal rate $RR_w(n)$ on a blanket wafer of an n-th lot obtained using Equation (5). The desired thicknesses (target thickness $T_{target}$) of BPSG layers after performing CMP on the initial thickness To thereof were all 8,500 Å, and the final thicknesses actually measured after CMP were denoted by $T_L$. Table 3 shows the result of continuously performing CMP of a subsequent lot for a CMP time Δt determined based on a variable removal rate set with a weighting factor obtained using Equation (5).

The results shown in Table 3 were obtained by substituting the removal rate obtained from a previous lot into the relationship equation of Equation (4) for determining a CMP time except for the sample wafer selected from the first lot. The thus-obtained results were confirmed to approximate the target thickness $T_{target}$ more closely than the typical method of determining a CMP time by the operator's view. From the above fact, it was confirmed that a CMP process for controlling a CMP time using an algorithm for calculating a variable removal rate set with a weighting factor in a sample-skip manner by a CLC system was made possible. Furthermore, it was seen that removal rate fluctuations between each head could be effectively reduced in a CMP equipment having four heads such as a MIRRA equipment.

In a multi-head type CMP equipment, it is difficult to know in which head will be perform CMP on a wafer under a thickness measurement. Thus, for example, after calculating the average value of removal rates exhibited by each head using Equation (5), a CMP time is determined based on this value thereby reducing fluctuations between the heads as small as possible.

EVALUATION EXAMPLE 3

This evaluation example involves calculating a CMP time of a subsequent run in a sample-skip manner using a variable removal rate set with a weighting factor to evaluate the effect actually obtained from an actual run. To this end, after having performed a CMP process in a sample-skip manner, as shown in Evaluation Example 2, the final thickness $T_L$ obtained as a result of CMP from four wafers among wafers of one lot, in which CMP is performed by four different heads, was compared. In this case, the desired thicknesses (target thickness $T_{target}$) of BPSG layers after CMP were all 8,500 Å. The results of this comparison are shown in Table 4 below.

TABLE 4

| Lot number | $T_L$ (Head 1) | $T_L$ (Head 2) | $T_L$ (Head 3) | $T_L$ (Head 4) |
|---|---|---|---|---|
| 1 | 8,318 | 8,450 | 8,254 | 8,093 |
| 2 | 8,382 | 8,560 | 8,491 | 8,644 |
| 3 | 8,432 | 8,575 | 8,503 | 8,538 |
| 4 | 8,568 | 8,499 | 8,493 | 8,444 |
| 5 | 8,384 | 8,357 | 8,394 | 8,437 |
| 6 | 8,354 | 8,453 | 8,556 | 8,392 |

Figure 6:
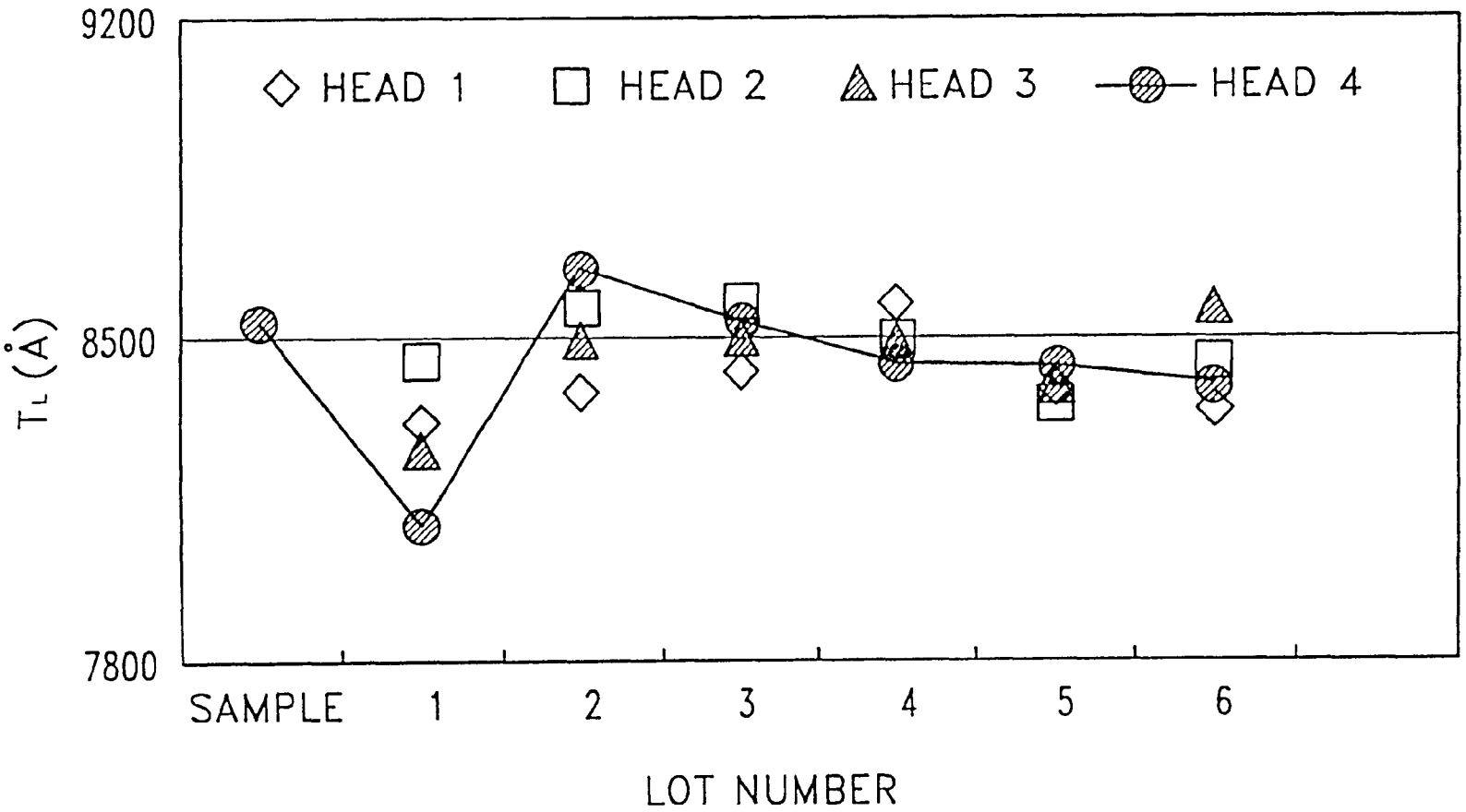
FIG. 6 is a graph showing final thickness variations after a CMP obtained by each lot in the case where the CMP time of a subsequent run is calculated in a sample-skip manner using a variable removal rate set with a weighting factor to perform a CMP process by the wafer polishing method according to the present invention.

The results of Table 4 are shown in FIG. 6. As are evident from Table 4 and FIG. 6, all the wafers subjected to CMP in

TABLE 3

| Lot No. | Number of wafer | $T_0$ (Å) | $T_{target}$ (Å) | Δt (sec) | $T_L$ (Å) | Removal rate $RR_b(n)$ (Å/sec) | Equation of removal rate $RR_w(n)$ for obtaining Δt |
|---|---|---|---|---|---|---|---|
| 1 (Sample) | 1 | 11,561 | 8,500 | 105 (pre-set) | 8,253 | 64.83 | Relationship equation of recipe 1 was used |
| 1 | 24 | 11,561 | 8,500 | 101 | 8,660 | 63.38 | 64.83 |
| 2 | 25 | 11,443 | 8,500 | 101 | 8,763 | 61.19 | 63.38 * 0.7 + 64.83 * 0.3 |
| 3 | 25 | 11,545 | 8,500 | 103 | 8,637 | 62.21 | 63.38 * 0.7 + 64.83 * 0.3 |
| 4 | 25 | 11,542 | 8,500 | 105 | 8,585 | 61.50 | 61.19 * 0.5 + 63.38 * 0.3 + 64.83 * 0.2 |
| 5 | 25 | 11,606 | 8,500 | 106 | 8,426 | 63.04 | 62.21 * 0.5 + 61.19 * 0.3 + 63.38 * 0.2 |
| 6 | 25 | 11,379 | 8,500 | 103 | 8,491 | 62.03 | 61.50 * 0.5 + 62.21 * 0.3 + 61.19 * 0.2 |

the four heads exhibited values approximating the target thickness $T_{target}$. That is, the algorithm using a variable removal rate set with a weighting factor according to the invention optimizes a removal rate so that it may approximate a target removal rate to sequentially substitute the optimized removal rate into the next lot. Thus, if CMP is performed using the algorithm according to the invention, the thickness of a polished layer on a wafer after CMP converges near 8,500 Å, which is the target thickness $T_{target}$, after the first two runs from a sample check. Furthermore, the algorithm using a variable removal rate set with a weighting factor reflects the average value of removal rates exhibited by each head, thus obtaining an excellent result approximating the target thickness $T_{target}$ from all other heads available as well as a specific head in which the thickness of the polished layer obtained after CMP is monitored.

Accordingly, performing CMP according to a sample-skip process which adopts the algorithm using a variable removal rate set with a weighting factor can offer improved throughput and reduce a processing time or ineffectiveness of a fabrication work, while effectively suppressing a thickness dispersion between lots and a thickness fluctuation between wafers in the same lot.

On the other hand, in the case of a usual CMP process performed on wafers from a main run of each lot after having checked a sample, it is uncertain to predict a CMP time. Furthermore, not only is an additional error due to operator's view reflected to make the result obtained after CMP inconsistent with a target value, but also over CMP or under CMP occurs to necessitate an additional CMP process, and worst of all, result in device defectiveness.

Figure 7A:
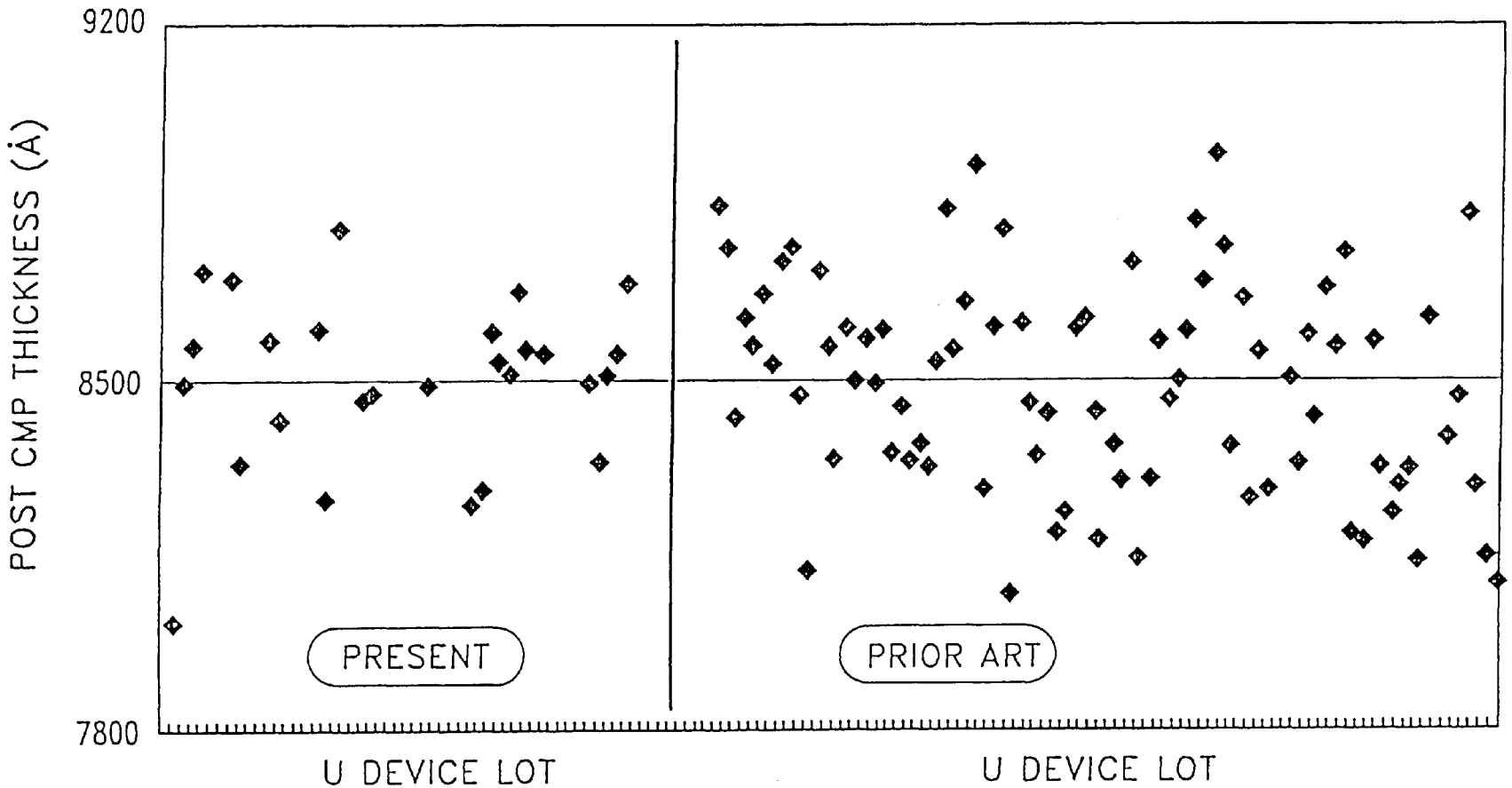
FIGS. 7A–7C are graphs showing improved dispersion in a post CMP thickness when a CMP process is performed on various products in a sample-skip manner using a variable removal rate set with a weighting factor by the wafer polishing method according to the present invention.
Figure 7B:
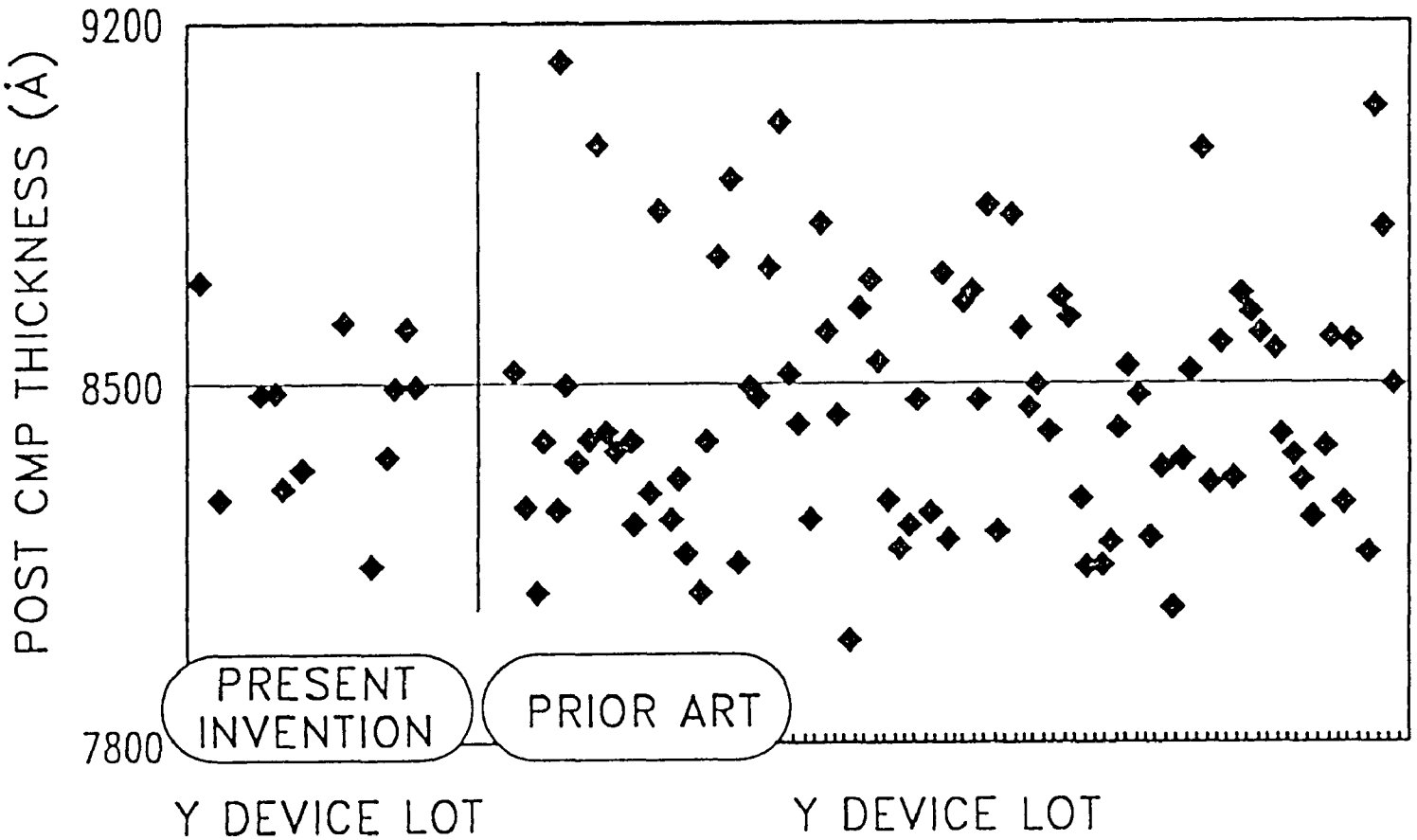
Figure 7C:
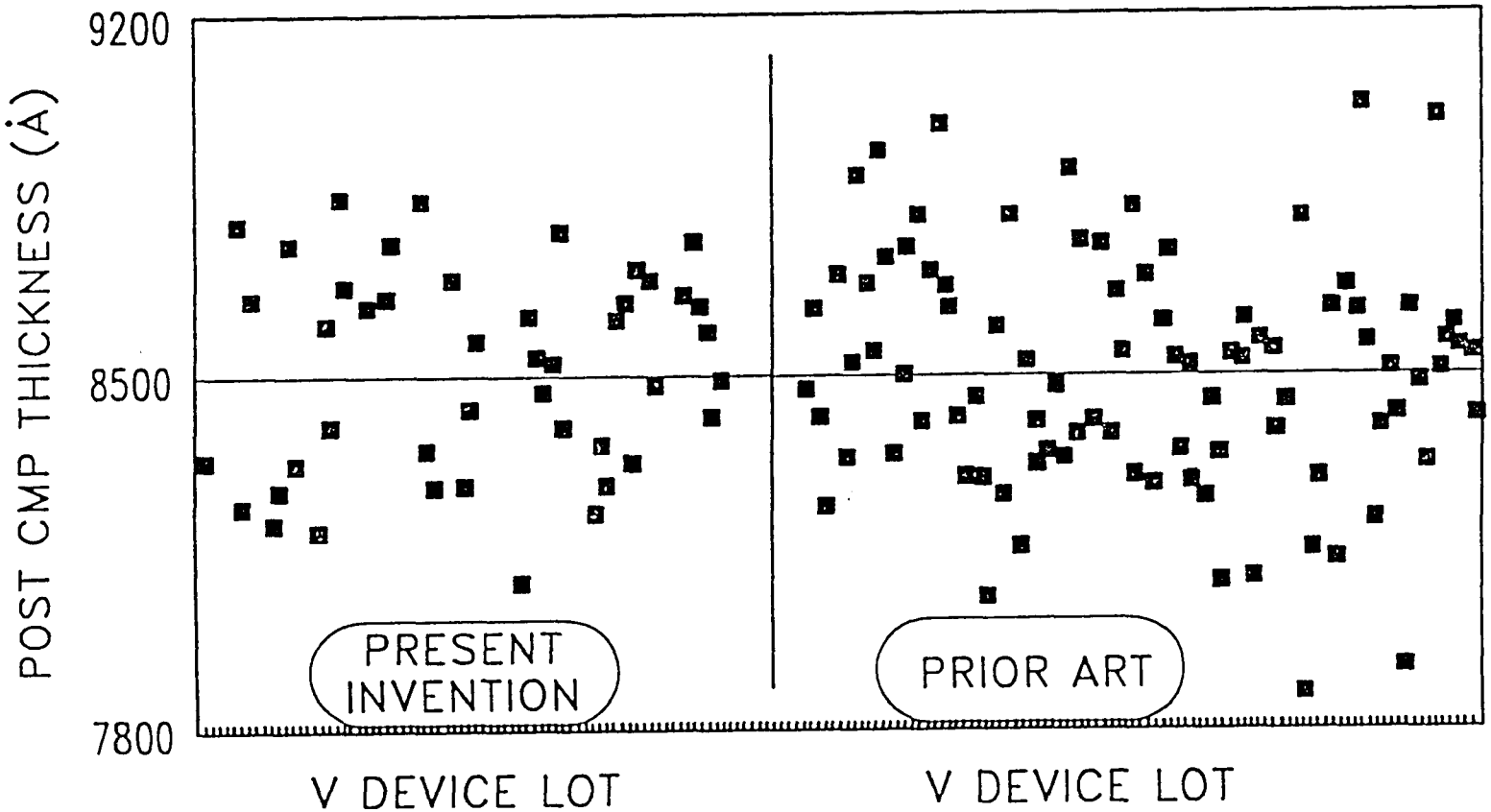

FIGS. 7A–7C are graphs showing that a sample-skip CMP process according to the algorithm using a variable removal rate set with a weighting factor offers a result better than a conventional CMP process. More specifically, FIG. 7A shows the distribution of post CMP thickness of a polished layer on a wafer after a CMP process for manufacturing a 64 M extended data output (EDO) DRAM product (hereinafter called product "U"). The post CMP thickness was obtained by an algorithm using a variable removal rate set with a weighting factor according to this invention, and by performing a main CMP after checking a sample on a lot-by-lot basis according to the conventional art, respectively.

FIG. 7B shows the distribution of post CMP thickness of a polished layer on a wafer after CMP for manufacturing a 128 M synchronous DRAM product (hereinafter called product "Y"). The post CMP thickness was obtained by an algorithm using a variable removal rate set with a weighting factor according to this invention and by performing a main CMP after checking a sample on a lot-by-lot basis according to the conventional art, respectively.

FIG. 7C shows the distribution of post CMP thickness of a polished layer on a wafer after CMP for manufacturing a 64 M synchronous DRAM product (hereinafter called product "V"). The post CMP thickness was obtained by an algorithm using a variable removal rate set with a weighting factor according to this invention and by performing main CMP after checking a sample on a lot-by-lot basis according to the conventional art, respectively.

It can be seen in FIGS. 7A–7C that a thickness fluctuation in the evaluated three products significantly decreases after performing CMP by the algorithm using a removal rate set with a weighting factor according to the invention. This means that the removal rate variation in a CMP equipment is effectively reflected in real time in the case of applying the algorithm according to the invention. As a consequence, the algorithm according to the invention allows improved throughput and dispersion of post CMP thickness as well as a sample-skip CMP process.

Meanwhile, it is difficult to perform a CMP process on various products using the same CMP equipment due to different patterns. Thus, during a CMP process of different products whose layers to be polished are of different patterns, a different CMP time must be given to approximate a target thickness even if the layers are of the same thickness. On the other hand, if an algorithm enabling a sample-skip process is applied to CMP for mass production, it is possible to mix and use different products. Thus, this eliminates the need to perform a new sample-skip process whenever a product to be polished is changed during CMP, while maintaining the effectiveness in a mass production process where CMP is performed on various kinds of products.

A CMP process to which the algorithm using a variable removal rate set with a weighting factor according to the present invention is adapted to calculate the removal rate on a blanket wafer from run data, and in the course of this calculation, a characteristic value "A" of a product undergoing CMP is considered. Thus, variable removal rate data set with a weighting factor obtained according to an algorithm used in the present invention represents the removal rate on a blanket wafer, and is independent of the type of products. Furthermore, when applying the removal rate on a blanket wafer to a subsequent run, a characteristic value "A" unique to a product is considered to predict a CMP time, and thus it is possible to mix different products. For example, characteristic values "A" of the products U, Y, and V used for evaluation shown in FIGS. 7A–7C were 4,049 Å, 4,367 Å, and 3,536 Å, respectively. Here, the different values "A", which reflect the characteristics of a pattern included in each product, mean that different kinds of products requires a different CMP time to obtain a target thickness.

Figure 8:
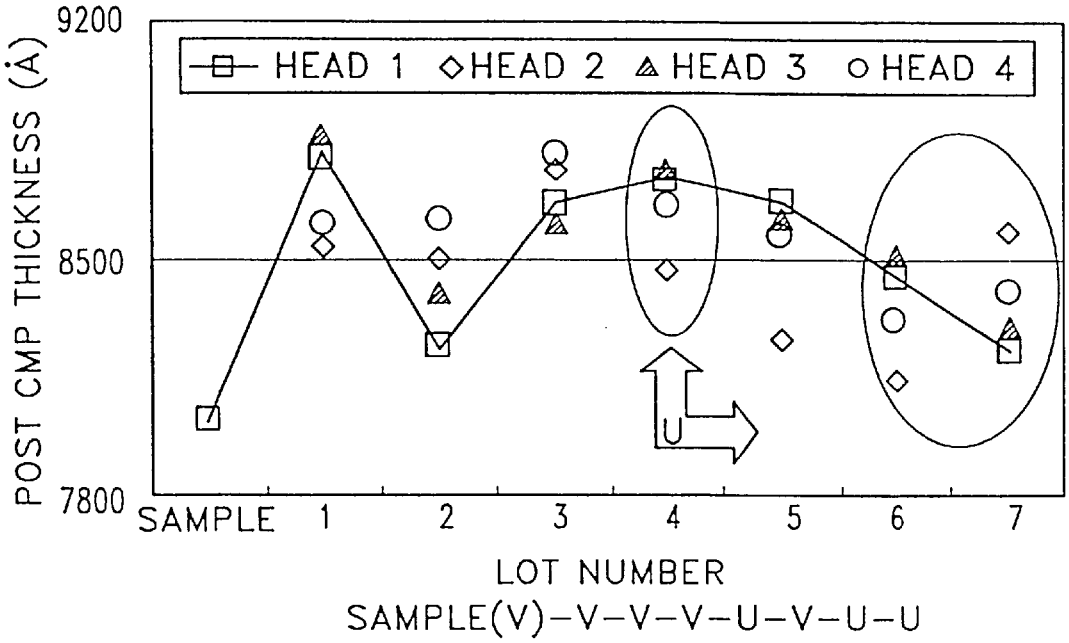
FIG. 8 is a graph showing the result of performing a CMP process on a mix of two kinds of products according to the present invention.

FIG. 8 is a graph showing a result of performing CMP on a mix of two products according to this invention. For evaluation of FIG. 8, after having performed a sample CMP process and three-time main run process with a wafer for the product V, a one-time main run process for a wafer for the product "U", a one-time main run process for a wafer for the product "V", and a two-time main run process for a wafer for the product "U" were sequentially performed. As shown in the result of FIG. 8, when using a mix of two kinds of products, the post CMP thickness obtained therefrom approximated the target thickness 8,500 Å, and dispersion of data obtained between wafers simultaneously subjected to CMP in different heads was improved to obtain data considerably approximating the target thickness.

Figure 9:
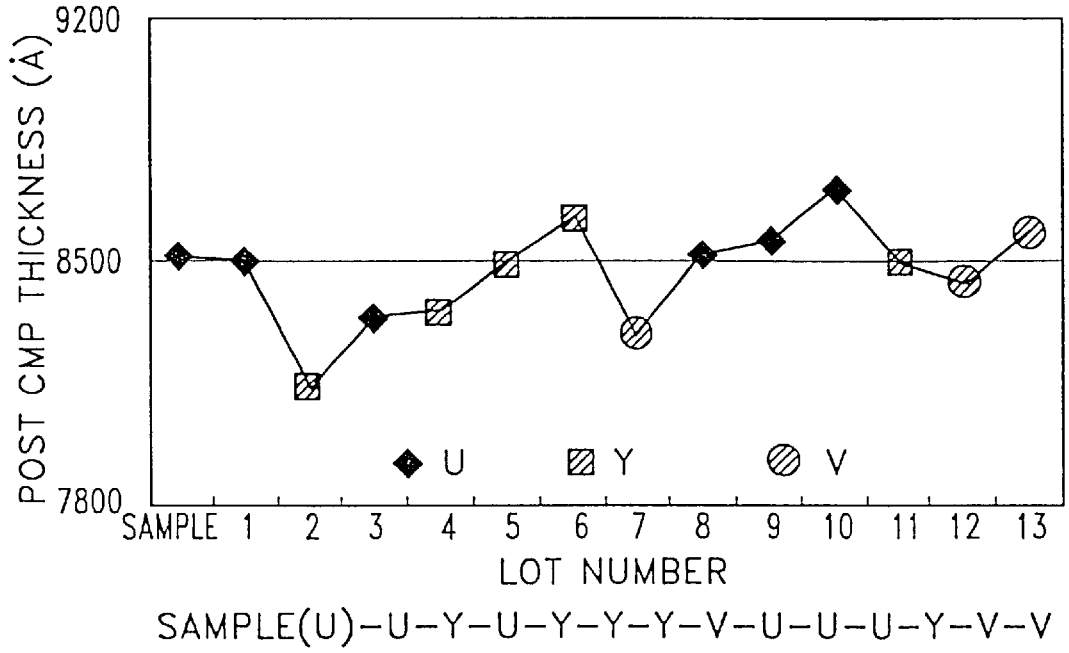
FIG. 9 is a graph showing the result of performing a CMP process on a mix of three kinds of products according to the present invention.

FIG. 9 is a graph showing the result of performing CMP on a mix of three products according to the present invention. The result of FIG. 9 shows that data approximating the target thickness can be obtained after CMP of a mix of three products including products "U", "Y" and "V". This means that the algorithm used in a CMP method according to the present invention can be feasibly applied to any type of products. That is, since the removal rate data obtained from a wafer polished in the preceding run regardless of the type of products is data for a blanket wafer, it is possible to apply the obtained data to a mix of different kinds of products.

To realize a sample-skip CMP process, the present invention is adapted to use an algorithm for determining the variable removal rate from the relationship equation of CMP process data for a patterned wafer of a previous lot and the removal rate of a layer to be polished on a blanket wafer essential for predicting a CMP time to control the polishing time for a wafer of a subsequent lot. The present invention provides high-precision prediction of a CMP time in the next lot according to an algorithm for effectively reflecting the removal rate of a polished layer which continuously varies depending on the characteristics of an equipment during polishing. Furthermore, according to this invention, the removal rate on a blanket wafer is calculated using an algorithm for obtaining a variable removal rate set with a weighting factor. Thus, a wafer polishing method according to the invention can effectively apply to a CMP equipment suffering from a large removal rate fluctuation, or a multi-head type CMP equipment, and thus allows the removal rate of a polished layer obtained after CMP using a plurality of heads to approximate a target value.

The present invention allows for a CMP process during which a CMP time of a next lot is in-situ controlled using an algorithm for calculating a variable removal rate set with a weighting factor in a sample-skip manner by a CLC system, while effectively reducing the removal rate fluctuation between heads by minimizing the variation range between lots which may increase due to use of a plurality of heads in a multi-head type CMP equipment. In addition, since removal rate data obtained from the algorithm according to the invention is data for a blanket wafer, it is possible to perform a CMP process on mixed different products regardless of the product type of a wafer polished in a previous run by a method according to the present invention.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A method of controlling the polishing time of a wafer lot, comprising:

performing a chemical mechanical polishing (CMP) process for a time $\Delta t(n)$ on a plurality of wafers on an n-th wafer lot among a plurality of wafer lots, each wafer lot consisting of a plurality of wafers;

calculating an amount removed $\Delta ToxP(n)$ from a polished layer on a selected one of the wafers of the n-th wafer lot;

calculating a predicted removal rate $RR_b(n)$ of a layer on a blanket wafer from the amount removed $\Delta ToxP(n)$; and determining a CMP time $\Delta t(n+1)$ for wafers on an n+1-th wafer lot using the equation $\Delta t(n+1)=\{\Delta ToxT(n+1)+A\}/RR_b(n)$ where "A" is a constant and $\Delta ToxT(n+1)$ is a target amount of a layer to be removed from each of the wafers of the n+1-th wafer lot.

2. The method of claim 1, wherein calculating the predicted removal rate $RR_b(n)$ of the layer on the blanket wafer includes using the equation $RR_b(n)=\{\Delta ToxP(n)+A\}/\Delta t(n)$, where "A" is a constant.

3. The method of claim 1, wherein calculating the predicted removal rate $RR_b(n)$ of the layer on the blanket wafer uses a weighted average value for at least two predicted removal rate data selected from $RR_b(1)$, $RR_b(2)$, $RR_b(3)$, . . . , $RR_b(n)$.

4. The method of claim 3, wherein calculating the predicted removal rate $RR_b(n)$ of the layer on the blanket wafer includes setting a same weighting factor for both of the at least two removal rate data.

5. The method of claim 3, wherein calculating the predicted removal rate $RR_b(n)$ of the layer on the blanket wafer includes setting at least two different weighting factors.

6. The method of claim 3, wherein calculating the predicted removal rate $RR_b(n)$ of the layer on the blanked wafer uses a plurality of predicted removal rate data which are sequentially and continuously selected from $RR_b(1)$, $RR_b(2)$, $RR_b(3)$, . . . , $RR_b(n)$.

7. The method of claim 3, wherein calculating the predicted removal rate $RR_b(n)$ of the layer on the blanket wafer uses a plurality of predicted removal rate data which are discontinuously selected from $RR_b(1)$, $RR_b(2)$, $RR_b(3)$, . . . , $RR_b(n)$.

8. The method of claim 1, further comprising determining the constant "A" from $\Delta ToxB=a*\Delta ToxP+A$ where $\Delta ToxP$ is an amount removed from a polished layer on a sample wafer among the plurality of wafer lots during a CMP process, where $\Delta ToxB$ is an amount that would be removed from a blanket wafer during a same time that the amount $\Delta ToxP$ was removed from the sample wafer if the blanket wafer was exposed to the same CMP process, and where "a" is a ratio of the removal rate of layers to be polished.

9. The method of claim 8, wherein polished layers on the wafers of the plurality of wafer lots are all formed of the same material, and "a" is substantially one.

10. The method of claim 1, further comprising:

performing a CMP process on one wafer selected among wafers of a first wafer lot for a time $\Delta t(s)$ to obtain an amount removed $\Delta ToxP(s)$ from a polished layer on the selected wafer, where n−1;

calculating a removal rate $RR_b(s)$ of the polished layer on the selected wafer from the amount removed $\Delta ToxP(s)$ by using the equation $RR_b(s)=\{\Delta ToxP(s)+A\}/\Delta t(s)$, where "A" is a constant; and determining a CMP time $\Delta t(1)$ of wafers of the first wafer lot from a target amount $\Delta ToxT(1)$ of a layer to be removed from the wafers of the first wafer lot, using the relationship equation $\Delta t(1)=\{\Delta ToxT(1)+A\}/RR_b(s)$, where "A" is a constant.

11. A method of polishing wafers, comprising:

calculating a predicted removal rate $RR_b(n)$ of a layer on a blanket wafer from chemical mechanical polishing (CMP) process data for a plurality of wafers of an n-th wafer lot, among a plurality of wafer lots, each wafer lot consisting of a plurality of wafers;

determining a CMP time $\Delta t(n+1)$ of wafers of an n+1-th wafer lot from a target amount $\Delta ToxT(n+1)$ of a layer to be removed from the wafers of the n+1-th wafer lot, using the equation $\Delta t(n+1)=\{\Delta ToxT(n+1)+A\}/RR_b(n)$, where "A" is a constant; and performing a CMP process on the wafers of the n+1-th wafer lot for the time $\Delta t(n+1)$.

12. The method of claim 11, wherein calculating the predicted removal rate $RR_b(n)$ of the layer on the blanket wafer comprises:

performing a CMP process on the wafers of the n-th wafer lot for a time $\Delta t(n)$ to calculate an amount removed $\Delta ToxP(n)$ from a polished layer on a selected one of the wafers of the n-th wafer lot; and calculating the predicted removal rate $RR_b(n)$ from the amount removed $\Delta ToxP(n)$.

13. The method of claim 12, wherein calculating the predicted removal rate $RR_b(n)$ of the layer on the blanket wafer uses the equation $RR_b(n)=\{\Delta ToxP(n)+A\}/\Delta t(n)$, where "A" is a constant.

14. The method of claim 11, wherein calculating the predicted removal rate $RR_b(n)$ of the layer on the blanket wafer uses a weighted average value for at least two predicted removal rate data selected from $RR_b(1)$, $RR_b(2)$, $RR_b(3)$, . . . , $RR_b(n)$.

15. The method of claim 14, wherein calculating the predicted removal rate $RR_b(n)$ of the layer on the blanket wafer includes setting weighting factors equal.

16. The method of claim 14, wherein calculating the predicted removal rate $RR_b(n)$ of the layer on the blanket wafer includes setting at least two removal rate data with a different weighting factor.

17. The method of claim 11, further comprising determining the constant "A" from $\Delta ToxB=a*\Delta ToxP+A$ where $\Delta ToxP$ is an amount removed from a polished layer on a sample wafer among the plurality of wafer lots during a CMP process, where $\Delta ToxB$ is an amount that would be removed from a blanket wafer during a same time that the amount $\Delta ToxP$ was removed from the sample wafer if the blanket wafer was exposed to the same CMP process, and where "a" is a ratio of the removal rate of layers to be polished.

18. The method of claim 11, wherein polished layers on the wafers of the plurality of wafer lots are all formed of the same material, and "a" is substantially one.

19. The method of claim 11, further comprising:

performing a CMP process on one wafer selected among wafers of a first wafer lot for a time $\Delta t(s)$ to obtain a removal amount $\Delta ToxP(s)$ of a polished layer on the selected wafer, where n=1;

calculating a removal rate $RR_b(s)$ of the polished layer on the selected wafer by using the relationship equation $RR_b(s)=\{\Delta ToxP(s)+A\}/\Delta t(s)$, where "A" is a constant;

determining a CMP time $\Delta t(1)$ of wafers of the first wafer lot from a target amount $\Delta ToxT(1)$ of a layer to be removed from the wafers of the first wafer lot, using the relationship equation $\Delta t(1)=\{\Delta ToxT(1)+A\}/RR_b(n)$, where "A" is a constant; and performing a CMP process on the remaining wafers of the first wafer lot except the selected wafer for the CMP time $\Delta t(1)$.

20. The method of claim 19, further comprising:

calculating an amount removed $\Delta ToxP(1)$ from the polished layer on the selected wafer of the first wafer lot after having performed CMP for the time $\Delta t(1)$; and calculating the removal rate $RR_b(1)$ of the polished layer on the selected wafer of the first wafer lot by using the relationship equation $RR_b(1)=\{\Delta ToxP(1)+A\}/\Delta t(1)$, where "A" is a constant.

21. The method of claim 20, wherein the amount removed $\Delta ToxP(1)$ is obtained from one selected from the remaining wafers.

22. The method of claim 11, further comprising sequentially performing the CMP process on a plurality of wafers of each wafer lot by two or more wafers using a CMP equipment having two or more heads.

23. The method of claim 22, further comprising sequentially performing the CMP process on the plurality of wafers of each wafer lot by four wafers using a CMP equipment having four heads.

24. The method of claim 11, further comprising sequentially performing the CMP process on at least two wafer lots having different removal requirements, wherein determining the CMP time includes using a different constant "A" for each wafer lot having different removal requirements.

25. The method of claim 24, wherein said different removal requirements are due to different patterns on different wafer lots.

* * * * *